US007678753B2

(12) United States Patent
Maki et al.

(10) Patent No.: US 7,678,753 B2
(45) Date of Patent: Mar. 16, 2010

(54) LIQUID DETERGENT COMPOSITION

(75) Inventors: Masataka Maki, Wakayama (JP); Hitoshi Ishizuka, Wakayama (JP); Nobuyoshi Yamaguchi, Wakayama (JP); Yuuichirou Tase, Wakayama (JP)

(73) Assignee: Kao Corporation, Tokyo (JP)

( * ) Notice: Subject to any disclaimer, the term of this patent is extended or adjusted under 35 U.S.C. 154(b) by 346 days.

(21) Appl. No.: 11/665,116

(22) PCT Filed: Nov. 14, 2005

(86) PCT No.: PCT/JP2005/020869

§ 371 (c)(1),
(2), (4) Date: Apr. 11, 2007

(87) PCT Pub. No.: WO2006/054526

PCT Pub. Date: May 26, 2006

(65) Prior Publication Data

US 2009/0022812 A1 Jan. 22, 2009

(30) Foreign Application Priority Data

Nov. 19, 2004 (JP) ..... 2004-336751
Nov. 19, 2004 (JP) ..... 2004-336752

(51) Int. Cl.
*C11D 3/00* (2006.01)
*C11D 7/18* (2006.01)
*C11D 7/54* (2006.01)
*C11D 9/42* (2006.01)

(52) U.S. Cl. ..... 510/372; 510/375; 510/378; 510/370; 510/303; 510/309; 510/311; 510/312; 510/316; 510/318; 510/367; 510/369

(58) Field of Classification Search ..... 510/303, 510/309, 311, 312, 316, 318, 319, 367, 369, 510/372, 375, 378, 518, 370
See application file for complete search history.

(56) References Cited

U.S. PATENT DOCUMENTS 4,483,778 A * 11/1984 Thompson et al. ..... 510/376
4,992,194 A * 2/1991 Liberati et al. ..... 510/303
5,073,285 A * 12/1991 Liberati et al. ..... 510/375
5,397,501 A * 3/1995 Coope ..... 252/186.42
5,484,555 A * 1/1996 Schepers ..... 8/137
5,879,409 A * 3/1999 Kott et al. ..... 8/137
6,218,351 B1 * 4/2001 Busch et al. ..... 510/311
6,306,812 B1 * 10/2001 Perkins et al. ..... 510/310
6,387,862 B2 * 5/2002 Busch et al. ..... 510/311
6,399,557 B2 * 6/2002 Perkins et al. ..... 510/310
6,494,920 B1 * 12/2002 Weuthen et al. ..... 8/137
6,624,132 B1 * 9/2003 Man et al. ..... 510/392
2004/0119048 A1 6/2004 Zhu et al.

FOREIGN PATENT DOCUMENTS

EP 0564250 A2 10/1993
JP 6-100888 A 4/1994
JP 9-48998 A 2/1997
JP 10-72595 A 3/1998
JP 10-072595 A * 3/1998
JP 10-072597 A * 3/1998
JP 10-72597 A 3/1998
JP 10-72598 A 3/1998
JP 10-251689 A 9/1998
JP 11-181492 A 7/1999
JP 2004-24715 A 1/2004

OTHER PUBLICATIONS

Derwent Abstracts, JP 10072597 A, Mar. 17, 1998, Fukano et al.*
Derwent Abstracts, JP 10072595 A, Mar. 17, 1998, Miyamae et al.*
Machine translation of Fukano et al. : JP10072597A.pdf.*
Machine translation of Miyamae et al. : JP10072595A.pdf.*
English language translation of JP 10-72597 A (Mar. 17, 1998).
English language abstract of JP 10-72595 A (Mar. 17, 1998).
English language abstract of JP 10-251689 A (Sep. 22, 1998).
English language abstract of JP 2004-24715 A (Jan. 29, 2004).
English language abstract of JP 11-181492 A (Jul. 6, 1999).
English language abstract of JP 10-72598 A (Mar. 17, 1998).
English language translation of JP 9-48998 A (Feb. 18, 1997).
English language abstract of JP 07-053994 (Feb. 28, 1995).
English language abstract of JP 07-070593 (Mar. 14, 1995).
English language abstract of JP 2000-144187 (May 26, 2000).
English language abstract of JP 10-072596 (Mar. 17, 1998).
European Search Report issued Dec. 1, 2009, in connection with European Patent Application No. 05 80 5949.

* cited by examiner

*Primary Examiner*—Mark Eashoo
*Assistant Examiner*—Jane L Stanley
(74) *Attorney, Agent, or Firm*—Birch, Stewart, Kolasch & Birch, LLP

(57) ABSTRACT

A liquid detergent composition containing (a) hydrogen peroxide or a compound for forming hydrogen peroxide in water, (b) a compound selected from boric acid, borax, a boric acid salt in an amount of from 0.05 to 1% by mass as a boron atom, (c) a compound having one or more sites, the site having one hydroxyl group at each of both sides of adjacent carbon atoms, in an amount of from 3 to 35% by mass, (d) a surfactant in an amount of from 4 to 45% by mass, and (e) water, wherein the molar ratio of the component (c)/the component (b) is from 1.5 to 2.7, and wherein the detergent composition has a pH at 20° C. of from 4.6 to 7.0.

14 Claims, No Drawings

LIQUID DETERGENT COMPOSITION

TECHNICAL FIELD

The present invention relates to a liquid detergent composition, a process for preparing the same, and a method of its use.

BACKGROUND ART

Techniques of liquid bleaching agents containing a boron compound and a saccharide have already been known, and Patent Publications 1 to 6 can be incorporated herein by reference. Also, these techniques also describe that the pH increases when a liquid bleaching agent is diluted.

Hydrogen peroxide is capable of exhibiting a bleaching effect in the form of a weak alkaline aqueous solution. However, since the stability of hydrogen peroxide is lowered under a weak alkaline condition, it is difficult to blend hydrogen peroxide with a neutral to weak alkaline, general liquid detergent composition, from the viewpoint of storage stability. In addition, since a commonly used bleaching activator has an active ester group, the bleaching activator quickly undergoes hydrolysis in a weak alkaline liquid detergent composition, thereby losing its activity and whereby the effect of the bleaching activator cannot be obtained at all in the actual washing situation. On the other hand, because stains due to spilled foods and the like can be effectively removed by bleaching, it is earnestly desired that hydrogen peroxide and a bleaching activator give a bleaching effect to a liquid detergent.

For the purpose of satisfying both the stability and the bleaching effect of hydrogen peroxide, techniques of making the pH of a manufactured article of a liquid detergent composition weakly acidic and raising the pH by diluting the liquid detergent composition with water have been known, and described in Publications 1 to 6 (hereinafter referred to as (pH jump system, or pH jump effect)). These techniques are accomplished by using together a boron compound and a polyhydric alcohol such as a saccharide. However, in many of these techniques, while the pH of a composition is adjusted to 4.5 or less and the pH jump effect is exhibited, the pH reached is less than 8. With such a dilute pH, the expected bleaching effect is insufficient. Even in the case where a bleaching activator is further used, the formation rate of an organic peracid from the bleaching activator is markedly delayed. Therefore, not only is the bleaching effect to be expected insufficient, but also the washing effect is also not satisfactory.

Patent Publication 7 discloses a branched bleaching activator, describing that the bleaching activator has excellent stability in a liquid bleach composition. However, this publication does not suggest at all that a liquid bleach composition is free from the disadvantage in the stabilities of both hydrogen peroxide and a bleaching activator at a pH of 4.6 or more in the pH jump system, or moreover that an organic peracid in a satisfactory amount is formed from a bleaching activator when diluted with water.

Patent Publication 1: JP-A-Hei-6-100888

Patent Publication 2: JP-A-Hei-7-53994

Patent Publication 3: JP-A-Hei-7-70593

Patent Publication 4: JP-A-Hei-10-72595

Patent Publication 5: JP 2000-144187 A

Patent Publication 6: JP-A-Hei-10-72596

Patent Publication 7: JP-A-Hei-10-251689

SUMMARY OF THE INVENTION

Specifically, the gist of the present invention relates to:

[1] a liquid detergent composition containing (a) hydrogen peroxide or a compound for forming hydrogen peroxide in water, (b) a compound selected from boric acid, borax, a boric acid salt in an amount of from 0.05 to 1% by mass as a boron atom, (c) a compound having one or more sites, the site having one hydroxyl group at each of both sides of adjacent carbon atoms, in an amount of from 3 to 35% by mass, (d) a surfactant in an amount of from 4 to 45% by mass, and (e) water, wherein the molar ratio of the component (c)/the component (b) is from 1.5 to 2.7, and wherein the detergent composition has a pH at 20° C. of from 4.6 to 7.0;

[2] a liquid detergent composition containing (A) hydrogen peroxide or a compound for forming hydrogen peroxide in water, (B) a compound selected from boric acid, borax, a boric acid salt in an amount of from 0.05 to 1% by mass as a boron atom, (C) a compound having one or more sites, the site having one hydroxyl group at each of both sides of adjacent carbon atoms, in an amount of from 3 to 35% by mass, (D) a bleaching activator having an alkanoyl group having 6 to 13 carbon atoms, the alkanoyl group having a side chain at the α-position or β-position to a carbonyl carbon in an amount of from 0.1 to 10% by mass, (E) a surfactant in an amount of from 4 to 45% by mass, and (F) water, wherein the molar ratio of the component (C)/the component (B) is from 1.6 to 4.0, and wherein the detergent composition has a pH at 20° C. of from 4.6 to 7.0;

[3] a method of using a liquid detergent composition used for obtaining at least any one of the effects of bleaching, washing, disinfection, or deodorization, including the steps of diluting the liquid detergent composition as defined in the above [2] with water in an amount of from 50 to 1500 times the volume, and heating the diluted composition to a temperature of 20° to 60° C.; and

[4] a process for preparing the liquid detergent composition as defined in the above [2], including the steps of mixing the component (B), the component (C), the component (E), and the component (F) to prepare a mother liquor having a pH of 3 to 7, and concurrently or separately adding the component (A) and the component (D) to the mother liquor.

DETAILED DESCRIPTION OF THE INVENTION

The present invention provides a liquid detergent composition having a pH jump effect to a level in which a bleaching effect and a detergent effect are satisfactory, and being free from the disadvantage in the stability of hydrogen peroxide. Also, the present invention relates to a liquid detergent composition in which an organic peracid is formed from a bleaching activator to a satisfactory level when diluted with water, which is free from the disadvantage in the stabilities of hydrogen peroxide and a bleaching activator when a bleaching activator is further used therewith.

Since the liquid detergent composition of the present invention has a pH jump effect of a level of satisfactory bleaching effect and detergent effect, and shows no disadvantage in the stability of hydrogen peroxide, an effect that a detergent having excellent bleaching properties can be obtained is exhibited by using the liquid detergent composition. Also, a liquid detergent composition blended with a bleaching activator exhibits an effect that excellent bleaching properties are obtained even after storage for a long period of time.

These and other advantages of the present invention will be apparent from the following description.

In the present invention, there are two embodiments: an embodiment without blending a bleaching activator (Embodiment A) and an embodiment blended with a bleaching activator (Embodiment B). Each of the embodiments will be explained hereinbelow.

Embodiment A

As mentioned above, the liquid detergent composition of the present invention contains (a) hydrogen peroxide or a compound for forming hydrogen peroxide in water, (b) a compound selected from boric acid, borax, a boric acid salt in an amount of from 0.05 to 1% by mass as a boron atom, (c) a compound having one or more sites, the site having one hydroxyl group at each of both sides of adjacent carbon atoms, in an amount of from 3 to 35% by mass, (d) a surfactant in an amount of from 4 to 45% by mass, and (e) water, wherein the molar ratio of the component (c)/the component (b) is from 1.5 to 2.7, and wherein the detergent composition has a pH at 20° C. of from 4.6 to 7.0.

In the present invention, since the liquid detergent composition has the above constitution, the liquid detergent composition exhibits excellent effects that have a pH jump effect of a level of satisfactory bleaching effect and detergent effect, and is free from the disadvantage in the stability of hydrogen peroxide.

The liquid detergent composition of the present invention contains as the component (a) hydrogen peroxide or a compound for forming hydrogen peroxide in water. The compound for forming hydrogen peroxide in water includes a percarbonic acid salt, a perboric acid salt and the like. The component (a) is contained as hydrogen peroxide in an amount preferably from 0.1 to 6% by mass, more preferably from 0.5 to 5% by mass, even more preferably from 1 to 4.5% by mass, and even more preferably from 1 to 3% by mass, of the composition. Within the above-mentioned range, excellent bleaching effects can be obtained.

One of the great features of the liquid detergent composition of the present invention resides in that a pH jump system containing as the component (b) a compound selected from boric acid, borax, a boric acid salt and as the component (c) a compound having one or more sites, the site having one hydroxyl group at each of both sides of adjacent carbon atoms, is used in a specified composition and at a specified ratio.

Since the present invention has such a feature, there is an advantage that an excellent pH jump effect and an excellent stability of hydrogen peroxide can be exhibited, as compared to the conventional pH jump system.

As the component (b), the boric acid salt includes sodium borate, potassium borate, ammonium borate, sodium tetraborate, potassium tetraborate, ammonium tetraborate and the like.

As specific examples of the component (c), the following compounds (1) to (4) are preferable, and one or more members selected from the group consisting of these compounds:

(1) a glycerol or a glycol selected from glycerol, diglycerol, triglycerol, an alkyl glyceryl ether and an alkyl polyglyceryl ether, e.g. an alkyl diglyceryl ether or an alkyl triglyceryl ether, each of which alkyl moiety has 1 to 10 carbon atoms, ethylene glycol and 1,2-propylene glycol;

(2) a sugar alcohol selected from sorbitol, mannitol, maltitose, inositol and phytic acid;

(3) a reducing saccharide selected from glucose, apiose, arabinose, galactose, lyxose, mannose, gallose, aldose, idose, talose, xylose and fructose; and (4) a polysaccharide selected from starch, dextran, xanthan gum, guar gum, curdlan, Pullulan, amylose and cellulose can be used.

In the present invention, the above-mentioned sugar alcohol (2) is especially suitable, which may be used alone or in plurality. In particular, sorbitol is preferable from the viewpoint of stability and bleaching/detergent effect. The reducing saccharide (3) needs be handled with care because a reducing aldehyde group influencing on the stability of hydrogen peroxide is present in the molecule.

In the present invention, it is preferable that the pH at 20° C. of a diluted liquid prepared by diluting a liquid detergent composition with water in an amount of 1,000 times the volume is 8.5 or more and less than 10.5, and preferably 9 or more and less than 9.5, for the purpose of obtaining a bleaching/detergent effect. For obtaining such a pH jump effect, the component (b) and the component (c) are controlled so as to have a mass ratio in a specific range and contents in a specific range.

Here, there is an equilibrium reaction between the component (b) and the component (c) (α,β-dihydroxy compound) as shown in the following formula (1).

[Ka 1]

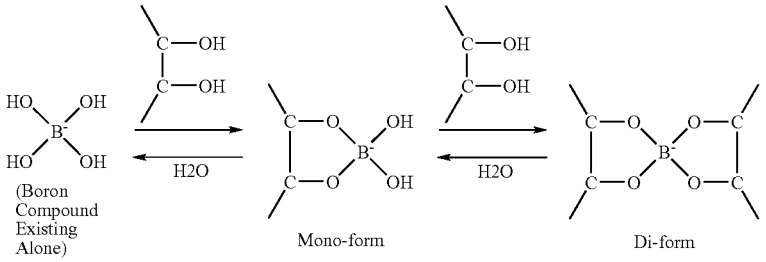

In the present invention, it is preferable that the di-form is a main component of the pH jump system for controlling the pH of a diluted solution to 8.5 or more and less than 10.5. It is preferable that the di-form is contained in an amount of from 70 to 100% by mol based on the entire boron compounds which are present in the liquid detergent composition, and that the mono-form is contained in an amount of 0% by mol or more and less than 5% by mol based on the entire boron compounds, and that boric acid, borax and/or a boric acid salt which is present alone is contained in an amount of 0% by mol or more and less than 25% by mol based on the entire boron compounds. When the mono-form, the di-form, the boric acid, borax and/or a boric acid salt which is present alone is beyond the range mentioned above, the pH jump effect is insufficient, so that a bleaching/detergent effect is less likely to be obtained. Also, when the component (c) is present in excess to the component (b), there is a risk of impairing the stability of hydrogen peroxide. Therefore, much care is needed in adjusting the above-mentioned ratio of the component (b) and the component (c). Accordingly, in the present invention, by mixing the components at a molar ratio of component (c)/component (b) (provided that in the case of borax and sodium tetraborate, these are regarded as 4 equivalents because four boron atoms are contained in these compounds), i.e. an extremely limited molar ratio range of from 1.5 to 2.7, preferably from 2.0 to 2.7, and more preferably from 2.2 to 2.7, both the excellent pH jump effect and stability of hydrogen peroxide of the present invention can be attained.

When the component (b) and the component (c) are blended in a liquid detergent composition in the present invention, these components are converted into the above-mentioned mono-form and di-form in the liquid detergent composition. Therefore, the phrase "the component (b) is contained in an amount of" means the entire amount of the component (b) which is present alone, or in a mono-form or a di-form. Therefore, the phrase "the component (c) is contained in an amount of" means the entire amount of the component (c) which is present alone, or in a mono-form or a di-form. The component (b) is contained as a boron atom in an amount of from 0.05 to 1% by mass, preferably from 0.15 to 0.5% by mass, and more preferably from in an amount of from 0.2 to 0.4% by mass, in the composition. The component (c) is contained an amount of from 3 to 35% by mass, preferably from 5 to 30% by mass, and more preferably from 10 to 20% by mass in the composition.

The content of converted mono-form and di-form can be calculated by using a combination of the $^{11}B$ NMR spectroscopy and ICP emission analysis methods.

In addition, in the present invention, a surfactant is contained as the component (d). Usable surfactants include nonionic surfactants, anionic surfactants, cationic surfactants and/or amphoteric surfactants.

The anionic surfactants (hereinafter referred to as component (d1)) include alkylbenzenesulfonates, polyoxyalkylene alkyl ether sulfuric ester salts, alkyl sulfuric ester salts, α-olefin sulfonates, α-sulfofatty acid salts or lower alkyl ester salts of α-sulfofatty acids and the like, each of which has an alkyl group or alkenyl group having 10 to 18 carbon atoms.

As the alkylbenzenesulfonates of the present invention, any compounds among those commercially distributed in the field of surfactants for detergents can be used, as long as the alkyl group has an average number of carbon atoms of from 8 to 16. For example, NEOPELEX F25 manufactured by Kao Corporation, Dobs 102 manufactured by Shell, and the like can be used. Industrially, alkylbenzenesulfonates can also be obtained by sulfonating an alkylbenzene widely distributed as a raw material for detergents with an oxidizing agent such as chlorosulfonic acid or a sulfurous acid gas. The alkyl group has an average number of carbon atoms of preferably from 10 to 14. Also, the polyoxyalkylene alkyl ether sulfate in the present invention can be obtained by adding EO in an amount of 0.5 to 5 mol in average per one molecule to a linear or branched primary alcohol or a linear secondary alcohol having an average number of carbon atoms of from 10 to 18, and sulfating the resulting product using a method described, for example, in JP-A-Hei-9-137188. The alkyl group has an average number of carbon atoms of preferably from 10 to 16. The alkyl sulfuric ester salt in the present invention can be obtained by sulfonating a linear or branched primary alcohol or a linear secondary alcohol having 10 to 16 carbon atoms, and preferably 10 to 14 carbon atoms with $SO_3$ or chlorosulfonic acid, and neutralizing the resulting product. The α-olefinsulfonate in the present invention can be obtained by sulfonating a 1-alkene having 8 to 18 carbon atoms with $SO_3$, and subjecting the resulting product to hydration and neutralization. The α-olefinsulfonate is a mixture of a compound in which a hydroxyl group is present in a hydrocarbon group and a compound in which an unsaturated bond is present. In addition, as the lower alkyl ester salt of an α-sulfofatty acid in the present invention, it is preferable that the alkyl group of the fatty acid residue has 10 to 16 carbon atoms, and that the lower alkyl ester moiety is a methyl ester or an ethyl ester, from the viewpoint of detergent effect. As the salts, sodium salts, potassium salts, magnesium salts, calcium salts, alkanolamine salts, ammonium salts or the like are preferable, and sodium salts, potassium salts and magnesium salts are preferable from the viewpoint of detergent effect.

In the present invention, the polyoxyethylene alkyl sulfuric ester salts having 10 to 14 carbon atoms in which ethylene oxide has a number of moles added in average of from 1 to 3, and the alkylbenzenesulfonates having 11 to 15 carbon atoms are especially preferable from the viewpoint of detergent effect.

The nonionic surfactant (hereinafter referred to as component (d2)) is preferably a compound of the following general formula (2):

$$R^{2a}—O(EO)_a(PO)_b—OH \quad (2)$$

wherein $R^{2a}$ is an alkyl group or alkenyl group having 10 to 18 carbon atoms, and preferably 12 to 14 carbon atoms; a is a number of moles added in average, which is a number of from 0 to 20; and b is a number of moles added in average, which is a number of from 0 to 20, with a proviso that the case where a and b are both 0 is excluded; the number of moles added in average a is preferably from 6 to 15, and more preferably from 7 to 12, and the number of moles added in average b is a number of from 0 to 10, more preferably from 1 to 5, and especially preferably from 1 to 3.

In the general formula (2), EO and PO may be arranged in either a form of a random copolymer or a block copolymer.

The cationic surfactant (hereinafter referred to as component (d3)), includes quaternary ammonium salts having one or two hydrocarbon groups having 10 to 18 carbon atoms optionally separated by an ester group or an amide group, and the remainder group being an alkyl group or a hydroxyalkyl group, each having 1 to 3 carbon atoms. The quaternary ammonium salt is preferably an alkyl sulfuric ester salt having 1 to 3 carbon atoms. When the cationic surfactant is used together with a bleaching activator, the stability may be lowered, so that much care is needed in blending the bleaching activator.

As the amphoteric surfactant (hereinafter referred to as component (d4)), it is preferable that a compound selected from those having the following general formula (3):

[Ka 2]

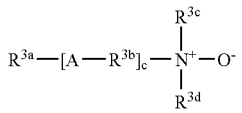

(3)

wherein $R^{3a}$ is a linear alkyl group or alkenyl group having 8 to 16 carbon atoms, preferably from 10 to 16 carbon atoms, and especially preferably from 10 to 14 carbon atoms; each of $R^{3c}$ and $R^{3d}$ is independently an alkyl group or a hydroxyalkyl group, each having 1 to 3 carbon atoms, and preferably a methyl group, an ethyl group or a hydroxyethyl group; $R^{3b}$ is an alkylene group having 1 to 5 carbon atoms, and preferably 2 or 3 carbon atoms. A is a group selected from —COO—, —CONH—, —OCO—, —NHCO— and —O—, and c is a number of 0 or 1, and the general formula (4):

[Ka 3]

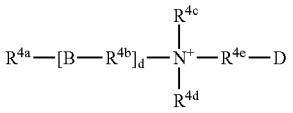

(4)

wherein $R^{4a}$ is an alkyl group or alkenyl group having 9 to 23 carbon atoms, preferably 9 to 17 carbon atoms, and especially preferably 9 to 15 carbon atoms; $R^{4b}$ is an alkylene group having 1 to 6 carbon atoms, and preferably 2 or 3 carbon atoms. B is a group selected from —COO—, —CONH—, —OCO—, —NHCO— and —O—, and d is a number of 0 or 1; each of $R^{4c}$ and $R^{4d}$ is independently an alkyl group or hydroxyalkyl group having 1 to 3 carbon atoms, and $R^{4e}$ is an alkylene group having 1 to 5 carbon atoms, and preferably 1 to 3 carbon atoms optionally substituted with a hydroxyl group; and D is a group selected from $—COO^-$, $—SO_3^-$, and $—OSO_3^-$ is contained from the viewpoint of detergent effect.

In the present invention, a surfactant selected from the components (d1) and (d2) is preferable.

In the present invention, the component (d) is contained in an amount of from 4 to 45% by mass in the liquid detergent composition, and the component (d) is contained in an amount of preferably from 10 to 40% by mass, and especially preferably from 20 to 35% by mass, from the viewpoint of solution stability during storage.

The amphoteric surfactant (d4) has a buffering ability. Therefore, when the amphoteric surfactant is used in a large amount, there is a risk of impairing the pH jump effect. Therefore, much care is needed upon its use. When used, it is preferable that the component (d4) is contained in an amount of 0.5% by mass or less, preferably 0.3% by mass or less, and especially 0.1% by mass or less.

In the present invention, the component (d2) is most preferable from the viewpoint of detergent effect, and especially, polyoxyalkylene alkyl ether type nonionic surfactants having an oxyethylene group and oxypropylene group are preferable, and polyoxyalkylene alkyl ether type nonionic surfactants wherein in the general formula (2) a is from 8 to 12 and b is from 0 to 3 are most preferable. It is desired that the component (d2) is contained in an amount of from 4 to 45% by mass, preferably from 10 to 40% by mass, and especially preferably from 20 to 40% by mass, of the composition.

In addition, in the present invention, it is preferable that a metal capturing agent is contained from the viewpoint of stability of hydrogen peroxide. The metal capturing agent is limited to compounds having a phosphonic acid group or a phosphonic acid salt group (hereinafter referred to as component (f)). Specific examples of the metal capturing agent having a phosphonic acid group or a phosphonate group include phosphonic acids selected from ethane-1,1-diphosphonic acid, ethane-1,1,2-triphosphonic acid, ethane-1-hydroxy-1,1-diphosphonic acid, ethanehydroxy-1,1,2-triphosphonic acid, ethane-1,2-dicarboxy-1,2-diphosphonic acid and methanehydroxyphosphonic acid or alkali metal salts or alkanolamine salts thereof, and phosphonocarboxylic acids selected from 2-phosphonobutane-1,2-dicarboxylic acid, 1-phosphonobutane-2,3,4-tricarboxylic acid, and α-methylphosphonosuccinic acid or alkali metal salts or alkanolamine salts thereof. Preferably phosphonic acids or alkali metal salts thereof are suitable. Especially, ethane-1-hydroxy-1,1-diphosphonic acid or alkali metal salts thereof are most preferable.

In the present invention, the component (f) is contained in an amount within the range of preferably 0.05% by mass or more and less than 0.3% by mass, more preferably from 0.1 to 0.25% by mass, and even more preferably from 0.15 to 0.2% by mass, from the viewpoint of obtaining a more preferred pH jump effect and the viewpoint of obtaining stability of hydrogen peroxide.

In the present invention, besides the phosphonic acid-based metal capturing agent, a fatty acid having a carboxyl group or a salt thereof, a polycarboxylic acid or a salt thereof, an aminopolycarboxylic acid or a salt thereof, and/or a polymeric chelating agent (hereinafter referred to as component (f')) may be used together. When these compounds are used, much care is needed because the pH jump effect is likely to be suppressed, and the pH of a diluted liquid is less than 8.5, so that there is a risk of being less likely to obtain a preferred bleaching/detergent effect. The fatty acid or a salt thereof as referred to herein is a saturated or unsaturated fatty acid having 1 to 18 carbon atoms or a salt thereof, and the polycarboxylic acid is a compound having a molecular weight of less than 1,000 and having two or more carboxyl groups in the molecule, such as citric acid and succinic acid. The aminopolycarboxylic acid or a salt thereof is a compound in which an acetic acid group or a succinic acid group is bonded to an amino group, such as ethylenediaminetetraacetic acid or a salt thereof, nitrilotriacetic acid or a salt thereof, and diethylenetriaminepentaacetic acid or a salt thereof. The polymeric chelating agent is a compound having a molecular weight of 1,000 or more and 100,000 or less, obtained by polymerizing a carboxylic acid compound having a polymerizable unsaturated bond, such as acrylic acid, methacrylic acid, maleic acid and crotonic acid. The molecular weights of these compounds are weight-average molecular weights, and can be determined by general methods such as the GPC (gel permeation chromatography) method or a light scattering method.

In the present invention, among the above-mentioned carboxylic acid compounds, when the fatty acid or a salt thereof, the polycarboxylic acid or a salt thereof, or the aminopolycarboxylic acid or a salt thereof is used, the total amount of those compounds in the composition is preferably less than 0.2% by mass, and more preferably less than 0.1% by mass.

In the present invention, the above-mentioned components (a), (b), (c), (d) and, if necessary, the component (f), are in the form of aqueous solutions prepared by dissolving these components in water, which is the component (e). The water to be used is preferably ion-exchanged water or distilled water obtained by removing very small amounts of metals dissolved in water, from the viewpoint of storage stability. The water, which is the component (e), is contained in an amount of from 40 to 70% by mass, and more preferably from 40 to 60% by mass.

The pH of the liquid detergent composition of the present invention at 20° C. is from 4.6 to 7.0, more preferably from 5 to 6.5, and especially preferably from 5 to 6. As the pH adjusting agent for adjusting the pH as mentioned above, an inorganic acid selected from hydrochloric acid and sulfuric acid and an inorganic base selected from sodium hydroxide and potassium hydroxide are preferably used. There is a risk of losing a pH jump effect when an organic acid selected from the above-mentioned components (f'), and phosphoric acid or the like is also used as the pH adjusting agent. Also, in the case of carbonates, much care is needed upon its use because there is a risk of impairing the pH jump effect.

For the purpose of improving the bleaching effect, the liquid detergent composition of the present invention may be used together with a bleaching activator. In the present invention, a composition blended with a bleaching activator is referred to as Embodiment B.

Embodiment B

The liquid detergent composition of the present invention contains (A) hydrogen peroxide or a compound for forming hydrogen peroxide in water, (B) a compound selected from boric acid, borax, a boric acid salt in an amount of from 0.05 to 1% by mass as a boron atom, (C) a compound having one or more sites, the site having one hydroxyl group at each of both sides of adjacent carbon atoms, in an amount of from 3 to 35% by mass, (D) a bleaching activator having an alkanoyl group having 6 to 13 carbon atoms, the alkanoyl group having a side chain at the α-position or β-position to a carbonyl carbon in an amount of from 0.1 to 10% by mass, (E) a surfactant in an amount of from 4 to 45% by mass, and (F) water, wherein the molar ratio of the component (C)/the component (B) is from 1.6 to 4.0, and wherein the detergent composition has a pH at 20° C. of from 4.6 to 7.0.

In the present invention, since the liquid detergent composition has the above constitution, the liquid detergent composition has a pH jump effect of a level of satisfactory bleaching effect and detergent effect, and exhibits an effect that an organic peracid is formed from a bleaching activator in a satisfactory level when diluted with water, which is free from the disadvantage in the stability of hydrogen peroxide and the bleaching activator.

The component (A), the component (B), and the component (C) in Embodiment B include the same ones as those of the component (a), the component (b), and the component (c) in Embodiment A, respectively. In addition, the range of the amount of the component (A) contained is the same as that of the component (a) in Embodiment A.

In the present invention, it is preferable that the pH at 20° C. of a diluted liquid prepared by diluting a liquid detergent composition with water in an amount of 1,000 times the volume is 8.5 or more and less than 10.5, for the purpose of obtaining a bleaching/detergent effect. For obtaining such a pH jump effect, the component (B) and the component (C) are controlled so as to have a molar ratio in a specific range and contents in a specific range.

Here, there is an equilibrium reaction as described in Embodiment A between the component (B) and the component (C) (α,β-dihydroxy compound).

Also in this Embodiment B, it is preferable that the above-mentioned di-form is a main component of the pH jump system, for adjusting the pH of a solution after the above-mentioned dilution of 1,000 times the volume to be 8.5 or more and less than 10.5. The di-form is contained in an amount of preferably from 70 to 100% by mol, based on the entire boron compounds which are present in the liquid detergent composition, the mono-form is contained in an amount of preferably from 0 to 5% by mol, based on the entire boron compounds, and the boric acid, borax and/or boric acid salt which is present alone is contained in an amount of preferably from 0 to 25% by mol, based on the entire boron compounds. When the mono-form, the di-form, and the boric acid, borax and/or a boric acid salt which is present alone is beyond the range mentioned above, the pH jump effect is insufficient, so that an excellent bleaching/detergent effect is less likely to be obtained. When the component (C) is present in excess of the component (B), there is a risk of impairing the stability of hydrogen peroxide. For this reason, much care is needed in order to adjust the ratio of the component (B) to the component (C) as mentioned above.

Therefore, in this Embodiment B, the molar ratio of the component (C)/component (B) (provided that the cases of borax and sodium tetraborate are regarded to be 4-equivalents since 4 boron atoms are contained) is from 1.6 to 4.0, preferably from 1.8 to 3.5, and more preferably from 2.0 to 2.8. By mixing the component (C)/component (B) in a liquid detergent composition in an extremely limited molar ratio as mentioned above, both the excellent pH jump effect of the present invention and the stability of hydrogen peroxide can be solved.

In the present invention, when the component (B) and the component (C) are blended in the liquid detergent composition, these components are converted into the above-mentioned mono-form or di-form in the liquid detergent composition. Therefore, in the instant specification, the amount of the component (B) contained means an entire amount of the component (B) which is present alone, or in a mono-form or a di-form. The amount of the component (C) contained means an entire amount of the component (C) which is present alone, or in a mono-form or a di-form. The component (B) of the present invention is contained in an amount of from 0.05 to 1.0% by mass, preferably from 0.15 to 0.5% by mass, and more preferably from 0.2 to 0.4% by mass as a boron atom, and the component (C) is contained in an amount of from 3 to 35% by mass, preferably from 5 to 30% by mass, and more preferably from 10 to 20% by mass. Here, when the component (B) is blended in an amount smaller than a given amount, the pH jump effect when being diluted becomes insufficient, and consequently, satisfactory effects in washing and bleaching are less likely to be obtained. On the other hand, when the component (B) is blended in an amount larger than the given amount, the pH jump effect after dilution is less likely to be easily obtained, and pH when being diluted 50 to 1,500 times the volume giving a concentration effective for bleaching/detergency is less likely to be raised easily. Further, when the component (B) is blended in a large amount, there are some disadvantages that separation and white turbidity of a solution are caused during storage of a manufactured article, thereby impairing its commercial value.

The amount of the converted mono-form and di-form contained can be calculated by a combination of the $^{11}B$ NMR spectroscopy and ICP emission analysis methods.

The component (D) of the present invention is a bleaching activator carrying an alkanoyl group having a total number of carbon atoms of 6 to 13 having a side chain at the α-position or β-position relative to the carbonyl carbon. In the present invention, one of the great features of the present invention resides in the use of the bleaching activator (D). The bleaching activator as mentioned above not only can remarkably improve the stability of a solution at lower temperatures, and but also quickly generate an organic peracid by its combined use with the above-mentioned pH jump system, as compared to a bleaching activator having a linear alkanoyl group. Accordingly, the bleaching activator as the component (D) in the present invention can give a high bleaching effect and a high detergent effect to the liquid detergent composition.

Further, the bleaching activator as the component (D) in the present invention has also an advantage that stability can be realized even in a pH range which has been conventionally considered to be difficult to stabilize (4.6 or higher), by the use of the bleaching activator together with a composition containing a boron compound and a diol compound.

The bleaching activator as the component (D) of the present invention is preferably a bleaching activator carrying an alkanoyl group having a total number of carbon atoms of 6 to 13 having a side chain at least one of the α-position and β-position relative to the above-mentioned carbonyl carbon.

Specific preferred compounds include a compound of the following general formula (5):

[Ka 4]

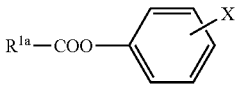

(5)

wherein $R^{1a}$—CO is an alkanoyl group having a total number of carbon atoms of 6 to 13, and preferably 7 to 13 and having a side chain at least one of the α-position and β-position relative to the carbonyl carbon, and $R^{1a}$- is preferably the following α-position branched type or β-position branched type.

[Ka 5]

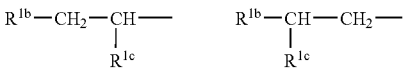

(α-position branched-type) (β-position branched-type)

wherein $R^{1b}$ is an alkyl group having 4 to 10 carbon atoms; $R^{1c}$ is a group selected from a methyl group, an ethyl group, a propyl group and a butyl group; X is a group selected from —COOM and —$SO_3M$; and M is a hydrogen atom, an alkali metal or an alkaline earth metal.

In one embodiment, in the general formula (5), a compound of α-position branched type can be obtained by subjecting a fatty aldehyde compound having 3 to 6 carbon atoms to aldol-condensation, thereafter oxidizing the aldehyde group, and subjecting the resulting α-branched type fatty acid (or an acid halide thereof) to an esterification reaction with p-hydroxybenzoic acid, salicylic acid or p-hydroxybenzenesulfonic acid.

Specific examples of the α-branched type fatty acids include 2-methylpentanoic acid, 2-ethylhexanoic acid, 2-propylheptanoic acid, 2-methylhexanoic acid, 2-ethylpentanoic acid, 2-ethylheptanoic acid, 3-propylhexanoic acid, 2-butyloctanoic acid and the like.

In one embodiment, in the general formula (5), a compound of β-position branched type can be obtained by subjecting a 1-alkene to hydroformylation, oxidizing the resulting aldehyde, and subjecting the resulting β-branched type fatty acid (or an acid halide thereof) to an esterification reaction with p-hydroxybenzoic acid, salicylic acid or p-hydroxybenzenesulfonic acid.

When a linear 1-alkene is used as a raw material, the fatty acid obtained through the hydroformylation process is a mixture of a β-branched fatty acid in which a methyl group is branched at the β-position with a linear fatty acid. In the present invention, it is preferable to use a fatty acid in which the mass ratio of the β-branched fatty acid/the linear fatty acid is from 20/80 to 80/20. As the branched 1-alkene, it is preferable to use a dimer or trimer of isobutene from the viewpoint of stability. 3,3,5-trimethylhexanoic acid, 3,6,8,8-tetramethylnonanoic acid and the like, each of which is a β-branched type fatty acid obtained by hydroformylation of the dimer or trimer of isobutene, are preferable.

The component (D) in the present invention can be obtained by an esterification reaction of the above-mentioned a-branched type fatty acid, β-branched type fatty acid or an acid anhydride or acid halide of these fatty acids with p-hydroxybenzoic acid, salicylic acid or p-hydroxybenzenesulfonic acid and salts thereof. In the case where the esterification reaction of an acid anhydride or an acid halide of a fatty acid with p-hydroxybenzoic acid or salicylic acid is carried out, a poly-adduct represented by the general formula (5-1), which can be obtained by further condensation of p-hydroxybenzoic acid or salicylic acid, can be formed.

[Ka 6]

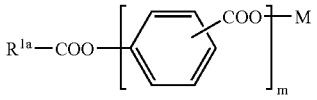

(5-1)

wherein $R^{1a}$ and M have the same meanings as defined above, and m is a number of 2 to 5.

The compound of the general formula (5-1) not only reacts with hydrogen peroxide in a bleaching bath or washing bath to form an organic peracid of $R^{1a}$—COOOH, but also produces a hydroxybenzene percarboxylic acid represented by the formula:

[Ka 7]

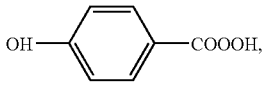

so that a very high bleaching effect can be obtained. Therefore, this compound is preferably contained in the composition. However, because of possibility of its influence on storage stability or the like, it is preferable that the amount of the compound of the general formula (5-1) is from 0.1 to 50% by mass, preferably from 0.1 to 30% by mass, and more preferably from 0.1 to 15% by mass based on the compound of the general formula (5).

As the component (D) in the present invention, in the general formula (5), $R^{1a}$—CO is preferably a 2-ethylhexanoyl group, a 3,5,5-trimethylhexanoyl group, a 2-ethylpentanoyl group or a 3,6,8,8-tetramethylnonanoyl group, and especially a 3,5,5-trimethylhexanoyl group is most preferable. Compounds in which X is —COOH are preferable, and a compound having —COOH at the p-position is most preferable.

The component (D) is contained in the liquid detergent composition of the present invention in an amount of from 0.1 to 10% by mass, preferably from 0.2 to 5% by mass, and more preferably from 0.2 to 2% by mass.

In the present invention, a surfactant is contained as the component (E). The usable surfactants include nonionic surfactants, anionic surfactants, cationic surfactants, and amphoteric surfactants. More specifically, the component (d) described in Embodiment A, concretely, components (d1) to (d4) are similarly used. The amount blended thereof is the same as that of Embodiment A, including preferable ranges.

In this embodiment B, surfactants selected from (d1) and (d2) are preferable, and especially inclusion of the component (d2) is preferable. In particular, polyoxyalkylene alkyl ether type nonionic surfactants having an oxyethylene group and oxypropylene group are preferable. Specifically, the polyoxyalkylene alkyl ether type nonionic surfactants of the general formula (2) in which $R^{2a}$ is an alkyl group having 10 to 14 carbon atoms, a is from 8 to 12, and b is from 1 to 3 (hereinafter referred to as (d2-1)) are most preferable. From the viewpoint of storage stability of the bleaching activator, the mass ratio of (d2-1)/(D) is from 4 to 400, preferably from 10 to 200, and more preferably from 20 to 100.

In this embodiment B, it is preferable that the metal capturing agent is contained from the viewpoint of the stability of hydrogen peroxide in the same manner as in Embodiment A while being optional. However, the metal capturing agent is limited to compounds having a phosphonic acid group or phosphonate group (phosphonic acid-based metal capturing agent, hereinafter referred to as component (G)) because of a possibility of impairing the effect of the pH jump system. Specific compounds and amounts thereof blended are the same as in Embodiment A, including preferable ranges.

Further, in some cases, besides phosphonic acid-based metal capturing agents, similar to that of Embodiment A, a fatty acid having a carboxyl group or a salt thereof, a polycarboxylic acid or a salt thereof, an aminopolycarboxylic acid or a salt thereof and/or a polymeric chelating agent (hereinafter referred to as the component (G')) are used together, in general. However, when the component (G') is used in a large amount, the pH jump effect is suppressed and the pH of a solution when diluted with water is less than a desired value, and consequently, a preferable bleaching/detergent effect cannot be obtained. The fatty acid or a salt thereof as referred to herein and the amount blended thereof are also the same as those in Embodiment A.

In this Embodiment B, it is preferable that the above-mentioned components (A) to (E), and the component (G) which is preferably contained though optional, are in the form of an aqueous solution dissolved in water, which is the component (F). The water to be used is ion-exchanged water or distilled water obtained by removing metals dissolved in a very small amount in water from the viewpoint of storage stability. The water, which is the component (F), is contained in an amount of from 40 to 70% by mass, and more preferably from 40 to 60% by mass.

The pH of the liquid detergent composition of the present invention at 20° C. is also the same as in Embodiment A.

The liquid detergent composition of this embodiment can be used, as a method of its use, for obtaining at least any one of the effects of bleaching, washing, disinfection and deodorization, including the steps of diluting the composition with water in an amount of from 50 to 1,500 times the volume, and heating the diluted solution at a temperature of from 20° to 60° C., and preferably from 25° to 40° C. It is more preferable that the composition is diluted with water in an amount of from 100 to 1,000 times the volume for obtaining at least any one of the effects of higher bleaching, washing, disinfection and deodorization.

The liquid detergent composition of the present invention is obtained by mixing each of the components. It is preferable to use a preparation process according to the following procedures, in order to stably blend a bleaching activator, the component (D), in the composition and obtain an even higher bleaching effect.

The process of the present invention includes the steps of mixing the component (B), the component (C), the component (E) and the component (F) to prepare a mother liquor having a pH of from 3 to 7, preferably from 3.5 to 6.5, and especially preferably from 4 to 6, and simultaneously or separately adding the component (A) and the component (D) to the mother liquor. In order that the components are separately added to the mother liquor, the component (A) may be previously added, or the component (D) may be previously added. Further, in order that the components are simultaneously added, the component (A) and the component (D) may be previously mixed, and thereafter the mixture may be added to the mother liquor. It is preferable that the component (A) and component (D) are separately and simultaneously added from the viewpoint of the stability of a bleaching activator. When adding the component (D) to the mother liquor, a part of the component (E) and the component (D) may be previously mixed, and this mixture may be added to the mother liquid. Further, in the case where the component (G) is used, the component (G) may be added together with other components upon preparing the mother liquor, or the pH adjusting agent is preferably ones described above. By adjusting the pH previously at this limited value, the component (B) is converted into a mono-form or di-form which is a multifunctional compound of the component (B) and the component (C), and the components (A) and (D) are then added, whereby hydrolysis of the bleaching activator can be suppressed so that stable blending can be carried out.

The form of the component (D) to be added may be any one of a raw powder or a solution state prepared by dissolving the component in any solvent, and it is preferable to add in a solution state, for shortening the processing time during the preparation. A preferred example of the solution state includes a process described in JP-B-2938788, paragraph Specifically, a solution prepared by dissolving a bleaching activator previously in a nonionic surfactant and/or water and adjusting the pH to from 3 to 7, and preferably from 4 to 6 is preferable.

The liquid detergent composition obtained by this preparation process can be re-adjusted with the above-mentioned pH adjusting agent. Much care is needed because there is a risk of impairing the stability of the bleaching activator.

The liquid detergent composition of the present invention is used in a process including the steps of diluting the composition with water, and carrying out bleaching/washing. The amount of water used in dilution is from 100 to 1,500 times the volume, and preferably from 200 to 1,000 times the volume based on the liquid detergent composition. By using the washing liquid as described above, an excellent bleaching/washing effect can be obtained.

The temperature at which the present detergent composition is diluted upon use is preferably a high temperature for the purpose of improving the bleaching and washing effect, and specifically it is preferable that the temperature is from 20° to 60° C., preferably from 25° to 50° C., and even more preferably from 30° to 40° C.

The bleaching object of the present invention preferably includes fibrous manufactured articles such as clothes. It is most preferable that the present invention is applied to a liquid laundry detergent composition for washing with a washing machine.

EXAMPLES

The present invention will be specifically described hereinbelow by the Examples, without intending to limit the scope of the present invention thereto.

Test Example A <Evaluation Method>

Liquid detergent compositions shown in Table 1 (inventive products A1 to A7 and comparative products A1 to A9) were prepared using blending components as shown in Table 1. Next, the resulting liquid detergent compositions were added so as to have a concentration of 0.1% by volume with 3°DH hard water of 20° C. Four pieces of cloths stained with meat sauce prepared as follows were washed with a Tergo-to-meter (100 rpm×10 minutes). Thereafter, the cloths were rinsed with tap water and dried, and the bleaching ratio was calculated according to the following formula. The results are shown in Table 1.

Bleaching ratio (%)=(Reflectance After Bleaching−Reflectance Before Bleaching)/(Reflectance of White Cloth−Reflectance Before Bleaching)×100

The reflectance was determined with NDR-10DP manufactured by Nippon Denshoku Kogyo K.K. using a 460 nm filter.

(Preparation of Stained Cloths)

The solid content of meat sauce manufactured by Kagome K.K. (can of meat sauce of fully ripened tomatoes (canned goods, best consumed before: Dec. 19, 2004, Lot No. D2Z19AB)/content 259 g)) was removed through a mesh (sieve opening: 500 μm), and the solution obtained was then heated to a boil. Cotton calico #2003 was soaked in this liquid, and boiled for 15 minutes. The soaked cotton calico was removed from the heat, and allowed to stand for about 2 hours to cool to 20° C. Thereafter, the cotton calico was taken out, and the liquid which was excessively adhered was removed with a spatula, and the calico was allowed to dry in the air. Thereafter, the calico was pressed to obtain a test cloth of 10 cm×10 cm which was used in an experiment.

<Storage Stability>

Stability of Hydrogen Peroxide

Liquid detergent compositions before storage and after storage for one month at 40° C. were titrated with a 1/10 N potassium permanganate solution, to determine an effective oxygen concentration. The stability of hydrogen peroxide was obtained according to the following formula.

Stability of Hydrogen Peroxide (%)=(Effective Oxygen Concentration After Storage)/(Effective Oxygen Concentration Before Storage)×100

TABLE 1

| | | Inventive Product | | | | | | | Comparative Product |
|---|---|---|---|---|---|---|---|---|---|
| | | A1 | A2 | A3 | A4 | A5 | A6 | A7 | A1 |
| Hydrogen Peroxide[1)] | a-1 | 5 | 5 | 4 | 4 | 5 | 5 | 2 | 5 |
| Boron Compound1) | b-1 | 4 | | 1.5 | | | 4 | 1.5 | |
| (lower row showing % by | | 0.70 | | 0.26 | | | 0.7 | 0.26 | |
| atom of B) | b-2 | | 1 | | 2.5 | 2 | | | 2 |
| | | | 0.21 | | 0.54 | 0.43 | | | 0.43 |
| Hydroxy Compound[1)] | c-1 | 30 | | 11 | | 15 | 30 | 11 | |
| | c-2 | | 7 | | | | | | |
| | c-3 | | | | 11 | | | | 5 |
| | c-4 | | | | | | | | 5 |
| Metal Capturing Agent[1)] | f-1 | 0.2 | 0.2 | 0.2 | 0.2 | 0.1 | 0.2 | 0.2 | 1 |
| | f-1 | | | | | | | | |
| Surfactant[1)] | d-1 | | 0.1 | | | 1 | | | |
| | d-2 | 10 | | 18 | 30 | 10 | 10 | 18 | 2 |
| | d-3 | | 35 | 18 | | | | 18 | |
| | d-4 | 0.1 | | | | | | | |
| | d-5 | | | | | | 0.1 | | 5 |
| Bleaching Activator[1)] | g-1 | 1 | 1 | | | | | | 2 |
| | g-2 | | | 1.5 | 1 | | | 1.5 | |
| $H_2O_2$ Stabilizing Agent[1)] | 4-Methoxyphenol | | | | | | | | |
| Water | e-1 | Bal. | Bal. | Bal. | Bal. | Bal. | Bal. | Bal. | Bal. |
| Total | | 100 | 100 | 100 | 100 | 100 | 100 | 100 | 100 |
| Adjustment of pH | | 5.1 | 5.5 | 6.0 | 6.0 | 5.5 | 5.1 | 6.0 | 4.5 |
| | c/b Value | 2.5 | 2.0 | 2.5 | 2.4 | 2.1 | 2.5 | 2.5 | 1.7 |
| | *Molar Ratio | | | | | | | | |
| pH when diluted 1,000 times the volume | | 9.5 | 9.0 | 9.3 | 9.2 | 9.5 | 9.5 | 9.5 | 7.8 |
| Bleaching Property Immediately After Preparation | % (25° C.) | 84 | 80 | 81 | 81 | 75 | 73 | 76 | 64 |
| Storage Stability of Hydrogen Peroxide | % (40° C., 1 mon.) | 98 | 98 | 98 | 98 | 99 | 99 | 99 | 98 |

| | | Comparative Product | | | | | | | |
|---|---|---|---|---|---|---|---|---|---|
| | | A2 | A3 | A4 | A5 | A6 | A7 | A8 | A9 |
| Hydrogen Peroxide[1)] | a-1 | 5 | 4 | 5 | 5 | 5 | 5 | 5 | 5 |
| Boron Compound1) | b-1 | | 4 | | | 1 | | 0.35 | 5.5 |
| (lower row showing % by | | | 0.70 | | | 0.17 | | 0.06 | 0.96 |
| atom of B) | b-2 | 4 | | 1 | 5 | | | | |
| | | 0.86 | | 0.21 | 1.07 | | | | |
| Hydroxy Compound[1)] | c-1 | 12 | 11 | | 15 | | 30 | 2.1 | 40 |
| | c-2 | | | 20 | | 20 | | | |
| | c-3 | | | | | | | | |
| | c-4 | | | | | | | | |

TABLE 1-continued

| | | | | | | | | | |
|---|---|---|---|---|---|---|---|---|---|
| Metal Capturing Agent[1)] | f-1 | 1 | 0.2 | 0.2 | 1 | 0.1 | 0.2 | 0.2 | 0.2 |
| | f'-1 | | | | 3 | 1 | | | |
| Surfactant[1)] | d-1 | | | 0.1 | 1 | 1 | | | |
| | d-2 | 2 | 18 | | 10 | | 10 | 10 | 10 |
| | d-3 | | 18 | 35 | | | | | |
| | d-4 | | | | | | 0.1 | 0.1 | 0.1 |
| | d-5 | | | | | 1 | | | |
| Bleaching Activator[1)] | g-1 | 1 | | 1 | | | 1 | 1 | 1 |
| | g-2 | | 1.5 | | | | | | |
| $H_2O_2$ Stabilizing Agent[1)] | 4-Methoxyphenol | 0.2 | | | | | | | |
| Water | e-1 | Bal. | Bal. | Bal. | Bal. | Bal. | Bal. | Bal. | Bal. |
| Total | | 100 | 100 | 100 | 100 | 100 | 100 | 100 | 100 |
| Adjustment of pH | | 6.0 | 6.0 | 5.5 | 3.0 | 4.5 | 5.1 | 5.1 | 5.1 |
| | c/b Value *Molar Ratio | 0.8 | 0.9 | 5.6 | 0.8 | 5.6 | — | 2.0 | 2.5 |
| pH when diluted 1,000 times the volume | | 8.2 | 8.3 | 8.2 | 6.7 | 7.5 | 6.5 | 7.2 | 7.8 |
| Bleaching Property Immediately After Preparation | % (25° C.) | 62 | 66 | 62 | 40 | 48 | 35 | 42 | 54 |
| Storage Stability of Hydrogen Peroxide | % (40° C., 1 mon.) | 99 | 98 | 90 | 99 | 89 | 99 | 98 | 96 |

[1)]% by mass of the detergent composition

<Blending Ingredients>

The following compounds were used as the components described in Table 1.

a-1: hydrogen peroxide b-1: boric acid b-2: sodium tetraborate c-1: sorbitol c-2: glucose c-3: glycerol c-4: APG (polyalkyl glucoside, C12, average degree of condensation: 1.5)

d-1: laurylbenzenesulfonate (LAS)

d-2: polyoxyethylene lauryl ether (number of average moles of oxyethylene added: 8, HLB: 13.1)

d-3: $C_{12}H_{25}O—(C_2H_4O)_6—(C_3H_6O)_2—(C_2H_4O)_5—H$ d-4: N-dodecyl-N,N,N-trimethylammonium methyl sulfate d-5: laurylamine oxide e-1: ion-exchanged water f-1: 1-hydroxyethylidene-1,1-diphosphonic acid Dequest 2010 (Dequest manufactured by SOLUTIA JAPAN INC.)

f'-1: sodium polycarbonate (molecular weight: 10,000)

g-1: sodium decanoyloxy-p-benzenesulfonate g-2: isononanoyloxy-p-benzenecarboxylic acid (3,5,5-trimethylhexanoyloxy-p-benzenecarboxylic acid)

It can be seen from the results in Table 1 that the detergent compositions obtained as the inventive products A1 to A7 all show a high bleaching property and have an excellent storage stability of hydrogen peroxide as compared with the comparative products A1 to A9.

Test Example B

Each of the components shown in Table 2 was mixed to provide liquid detergent compositions (inventive products B1-1 to B1-7, and comparative products B1-1, B1-4). Using the resulting liquid detergent compositions, the stability of the bleaching activator, the stability of hydrogen peroxide and the bleaching ratio after storage thereof were evaluated by the following methods. The results are shown in Table 2. The pH of the liquid detergent composition after being diluted with water at 20° C. 1,000 times the volume is also shown in Table 2.

<Evaluation Method>

The liquid detergent compositions shown in Table 2 were added so as to have a concentration of 0.1% by volume with 3°DH hard water of 20° C., and four pieces of cloths stained with meat sauce prepared as follows were Washed with a Tergo-to-meter (100 rpm×10 minutes). Thereafter, the cloths were rinsed with tap water and dried, and the bleaching ratio was calculated by the following formula. The results are shown in Table 2.

Bleaching ratio (%)=(Reflectance After Bleaching−Reflectance Before Bleaching)/(Reflectance of White Cloth−Reflectance Before Bleaching)×100

The reflectance was determined with NDR-10DP manufactured by Nippon Denshoku Kogyo K.K. using a 460 nm filter.

(Preparation of Stained Cloths)

The solid content of meat sauce manufactured by Kagome K.K. (can of meat sauce of fully ripened tomatoes (canned goods, best consumed before: Dec. 19, 2004, Lot No. D2Z19AB)/content 259 g)) was removed through a mesh (sieve opening: 500 μm), and the solution obtained was then heated to a boil. Cotton calico #2003 was soaked in this liquid, and boiled for 15 minutes. The heated soaked cotton calico was removed from the heat, and allowed to stand for about 2 hours to cool to 30° C. Thereafter, the cotton calico was taken out, and the liquid which was excessively adhered was removed with a spatula, and the calico was allowed to dry in air. Thereafter, the calico was pressed to obtain a test cloth of 10 cm×10 cm which was used in an experiment.

<Storage Stability>

Stability of Hydrogen Peroxide

The stability was measured in the same manner as in Test Example A.

<Storage Stability>

Stability of Bleaching Activator

The content of the bleaching activator in the liquid detergent composition before storage and after storage for 1 week at 20° C. was determined by high-performance liquid chromatography, and the residual ratio of the bleaching activator was calculated according to the following formula.

Residual Ratio of Bleaching Activator (%)=(Bleaching Activator Content After Storage)/(Bleaching Activator Content Before Storage)×100

<Preparation Process>

The composition B1-1 shown in Table 2 was prepared by the following three kinds of preparation processes, and the effective content of the bleaching activator in the initial period of blending was determined by high-performance liquid chromatography. The results are shown below.

Example B1

Components (B), (C), (E), (F) and (G) were previously mixed to dissolve. Next, the pH of a liquid detergent was adjusted with 5% NaOH so that a final liquid detergent had a pH of 5 (pH at this stage: 5.2). Thereafter, a component (A) was added and finally a raw powder of a component (D) was mixed to dissolve, to prepare a liquid detergent composition. The effective content of the component (D) was 0.99% by weight as compared to 1% by weight of the component (D) which was added.

Example B2

Components (B), (C), (E), (F) and (G) (provided that the amounts of the components (E) and (F) are the balance resulting from previously subtracting the amounts necessary for the preparation of a component (D) into a solution from a total amount thereof) were mixed to dissolve. Next, the pH of the liquid detergent was adjusted with 5% NaOH so that a final liquid detergent had a pH of 5 (pH at this stage; 5.2). Thereafter, the component (D) previously prepared into a solution ((D)/(E-3)/(F)=10/5/85 (weight ratio)) was added thereto, and finally a component (A) was mixed to dissolve, to prepare a liquid detergent composition. The effective content of the component (D) was 1.00% by weight, as compared to 1% by weight of the component (D) which was added.

Comparative Example B1

Components (A) to (G) were mixed to dissolve at one time (pH at this stage: 1.9), and the pH was then adjusted with 5% NaOH so as to have a pH of to 5. The effective content of the component (D) was 0.79% by weight compared to 1% by weight of the component (D) which was added.

TABLE 2

| Blending Ingredient | | Liquid Detergent Composition | | | | | | | | | | |
|---|---|---|---|---|---|---|---|---|---|---|---|---|
| | | Inventive Product | | | | | | | Comparative Product | | | |
| (% by mass) | | B1-1 | B1-2 | B1-3 | B1-4 | B1-5 | B1-6 | B1-7 | B1-1 | B1-2 | B1-3 | B1-4 |
| A-1 | Hydrogen Peroxide | 4 | 4 | 4 | 4 | 4 | 4 | 4 | 4 | 4 | 4 | 4 |
| B-1 | Boron Compound | 1 | | 1.5 | 1.5 | | | 1 | 1 | | 3 | 1 |
| | (lower row showing | 0.17 | | 0.26 | 0.26 | | | 0.17 | 0.17 | | 0.52 | 0.17 |
| B-2 | % by atom of B) | | 2 | | | 1 | 1.5 | 0.5 | | | | |
| | | | 0.43 | | | 0.21 | 0.32 | 0.11 | | | | |
| C-1 | Diol Compound | | | 11 | | | 8 | 5 | | | | 20 |
| C-2 | | 8 | 7 | | | | | 2.5 | 8 | | | |
| C-3 | | | 7 | | 6 | | | 2.5 | | | | |
| C-4 | | | | | | 15 | 6 | | | | 15 | |
| G-1 | Metal Capturing | 0.2 | | 0.2 | 0.1 | 0.1 | | 0.25 | 0.2 | 0.2 | 0.3 | 0.2 |
| G'-1 | Agent | | 0.2 | | 0.1 | | 0.1 | | | | | |
| E-1 | Surfactant | 1 | | | | 0.2 | | 1 | 1 | | | |
| E-2 | | | 0.5 | 20 | | | 0.5 | | | | 2 | 20 |
| E-3 | | 20 | 30 | | 20 | 25 | 20 | 25 | 20 | 20 | | |
| E-4 | | | | | 0.5 | | 0.2 | | | | | |
| E-5 | | 0.1 | | | 0.1 | | | 0.1 | 0.1 | | | |
| F-1 | Ion-Exchanged Water | Bal. | Bal. | Bal. | Bal. | Bal. | Bal. | Bal. | Bal. | Bal. | Bal. | Bal. |
| D-1 | Bleaching Activator | | | | | | | | 1 | | 1 | |
| D-2 | | 1 | 1 | 1 | 1 | 1 | 1 | 1 | | 1 | | 1 |
| Total | | 100 | 100 | 100 | 100 | 100 | 100 | 100 | 100 | 100 | 100 | 100 |
| C/B Value *Molar Ratio | | 2.7 | 2.9 | 2.5 | 2.7 | 1.8 | 1.9 | 2.6 | 2.7 | — | 0.7 | 6.8 |
| pH[1)] | | 5 | 5 | 5 | 5.5 | 4.8 | 5.5 | 6 | 5 | 5.5 | 4.0 | 5.0 |
| pH After Being Diluted (1,000 times)[2)] | | 9 | 9 | 8.8 | 9.2 | 8.6 | 9.2 | 9.2 | 9 | 6.4 | 7.5 | 8 |
| Stability of Bleaching Activator (%) | | 90 | 92 | 95 | 81 | 88 | 80 | 78 | 5 | 34 | 15 | 18 |
| Stability of Hydrogen Peroxide (%) | | 100 | 100 | 100 | 99.8 | 100 | 99.5 | 99.1 | 95 | 82 | 99.5 | 73 |

TABLE 2-continued

| Blending Ingredient | Liquid Detergent Composition | | | | | | | | | | |
|---|---|---|---|---|---|---|---|---|---|---|---|
| | Inventive Product | | | | | | | Comparative Product | | | |
| (% by mass) | B1-1 | B1-2 | B1-3 | B1-4 | B1-5 | B1-6 | B1-7 | B1-1 | B1-2 | B1-3 | B1-4 |
| Bleaching Property for Meat Sauce Stains After Storage (%/40° C.) | 82 | 78 | 75 | 82 | 75 | 82 | 86 | 51 | 47 | 58 | 63 |

[1)]pH of Liquid Detergent Composition After Adjustment (20° C.)
[2)]pH After Dilution by 1000 times (20° C.)
The following compounds were used as each of the components in the table.
<Blending Ingredient>
A-1: hydrogen peroxide
B-1: boric acid
B-2: sodium tetraborate
C-1: sorbitol
C-2: glucose
C-3: glycerol
C-4: APG (polyalkyl glucoside, C12, average degree of condensation: 1.5)
G-1: 1-hydroxyethylidene-1,1-diphosphonic acid Dequest 2010 (Dequest manufactured by SOLUTIA JAPAN INC.)
G'-1: sodium polycarboxylate (molecular weight: 10,000)
E-1: laurylbenzenesulfonate (LAS)
E-2: polyoxyethylene lauryl ether (number of average moles of oxyethylene added: 8, HLB: 13.1)
E-3: $C_{12}H_{25}O—(C_2H_4O)_6—(C_3H_6O)_2—(C_2H_4O)_5—H$
E-4: N-dodecyl-N,N,N-trimethylammonium methyl sulfate
E-5: laurylamine oxide
F-1: ion-exchanged water
D-1: sodium decanoyloxy-p-benzenesulfonate
D-2: isononanoyloxy-p-benzenecarboxylic acid (3,5,5-trimethylhexanoyloxy-p-benzenecarboxylic acid)
D-3: sodium isononanoyloxy-p-benzenesulfonate (sodium 3,5,5-trimethylhexanoyloxy-p-benzenesulfonate)

It can be seen from the results in Table 2 that the inventive products B1-1 to B1-7 all have a pH of exceeding 8 after being diluted, and extremely excellent stability of the bleaching activator, and show a remarkably high bleaching ratio after storage, as compared to the comparative products B1-1 to B1-4. Further, it can be seen that the inventive products have a hydrogen peroxide stability equivalent to or greater than that of the comparative products.

INDUSTRIAL APPLICABILITY

The liquid detergent composition of the present invention can be suitably used as a liquid detergent composition for washing of fibrous manufactured articles such as clothes, especially a liquid detergent composition for washing machines.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A liquid detergent composition comprising:

(a) hydrogen peroxide, (b) a compound selected from the group consisting of boric acid, borax, and a boric acid salt in an amount of from 0.05 to 1% by mass as a boron atom, (c) one or more compounds selected from the group consisting of glycerol, diglycerol, triglycerol, sugar alcohol and a reducing saccharide, in an amount of from 3 to 35% by mass, (d) a surfactant in an amount of from 4 to 45% by mass, and (e) water, wherein the molar ratio of the component (c) to the component (b) is from 1.5 to 2.7, and wherein the detergent composition has a pH at 20° C. from 4.6 to 7.0;

wherein a diluted solution prepared by diluting the liquid detergent composition with water in an amount of 1,000 times the volume of the composition has a pH at 20° C. of 8.5 to 10.5.

2. The liquid detergent composition according to claim 1, wherein the component (c) is a sugar alcohol.

3. The liquid detergent composition according to claim 1, wherein the component (d) comprises a nonionic surfactant.

4. The liquid detergent composition according to claim 1, further comprising (f) a metal ion capturing agent having a phosphonic acid group or a phosphonate group in an amount of from 0.05% by mass or more and less than 0.3% by mass.

5. The liquid detergent composition according to claim 1, further comprising one or more compounds selected from the group consisting of a fatty acid or a salt thereof, a polycarboxylic acid or a salt thereof, and an aminopolycarboxylic acid or a salt thereof, wherein a total content thereof is less than 0.2% by mass.

6. A liquid detergent composition comprising:

(A) hydrogen peroxide, (B) a compound selected from the group consisting of boric acid, borax, and a boric acid salt in an amount of from 0.05 to 1% by mass as a boron atom, (C) one or more compounds selected from the group consisting of glycerol, diglycerol, triglycerol, sugar alcohol and a reducing saccharide, in an amount of from 3 to 35% by mass, (D) a bleaching activator having an alkanoyl group having 6 to 13 carbon atoms, the alkanoyl group having a side chain at the α-position or β-position to a carbonyl carbon in an amount of from 0.1 to 10% by mass, (E) a surfactant in an amount of from 4 to 45% by mass, and (F) water, wherein the molar ratio of the component (C) to the component (B) is from 1.6 to 4.0, and wherein the detergent composition has a pH at 20° C. from 4.6 to 7.0;

wherein a diluted solution prepared by diluting the liquid detergent composition with water in an amount of 1,000 times the volume of the composition has a pH at 20° C. of 8.5 to 10.5.

7. The liquid detergent composition according to claim 6, wherein the component (C) is a sugar alcohol.

8. The liquid detergent composition according to claim 6, further comprising (G) a phosphonic acid-based metal ion capturing agent in an amount of from 0.05% by mass or more and less than 0.3% by mass.

9. The liquid detergent composition according to claim 6, further comprising one or more compounds selected from the group consisting of a fatty acid or a salt thereof, a polycarboxylic acid or a salt thereof, and an aminopolycarboxylic acid or a salt thereof, wherein a total content thereof is less than 0.2% by mass.

10. The liquid detergent composition according to claim 6, wherein the component (E) comprises a nonionic surfactant.

11. The liquid detergent composition according to claim 10, wherein the nonionic surfactant is a polyoxyalkylene alkyl ether type nonionic surfactant having an oxyethylene group and an oxypropylene group.

12. A method of using a liquid detergent composition used for obtaining at least any one of the effects of bleaching, washing, disinfection, or deodorization, comprising the steps of diluting the liquid detergent composition as defined in claim 6 with water in an amount of from 50 to 1500 times the volume, and heating the diluted composition to a temperature of 20° to 60° C.

13. A process for preparing the liquid detergent composition as defined in claim 6, comprising the steps of mixing the component (B), the component (C), the component (E), and the component (F) to prepare a mother liquor having a pH of 3 to 7, and concurrently or separately adding the component (A) and the component (D) to the mother liquor.

14. The process for preparing the liquid detergent composition according to claim 13, wherein a part of the component (E) is previously mixed with the component (D) and added upon the addition of the component (D) to the mother liquor.

* * * * *